US006162105A

United States Patent [19]

Breivik

[11] Patent Number: 6,162,105

[45] Date of Patent: Dec. 19, 2000

[54] TWO-PART SHIP FOR USE IN OIL TRANSPORT IN ARCTIC WATERS

[75] Inventor: Kare G. Breivik, Tau, Norway

[73] Assignee: Den Norske Stats Oljeselskap A.S., Stavanger, Norway

[21] Appl. No.: 09/402,765

[22] PCT Filed: Sep. 9, 1977

[86] PCT No.: PCT/NO97/00241

§ 371 Date: Oct. 11, 1999

§ 102(e) Date: Oct. 11, 1999

[87] PCT Pub. No.: WO98/46477

PCT Pub. Date: Oct. 22, 1998

[30] Foreign Application Priority Data

Apr. 11, 1997 [NO] Norway ..... 971690

[51] Int. Cl.[7] ..... B63B 22/02

[52] U.S. Cl. ..... 441/4; 114/74 R; 114/77 R

[58] Field of Search ..... 114/40, 41, 24 R, 114/230.1, 230.12, 248, 77 R, 77 A; 441/3–5

[56] References Cited

U.S. PATENT DOCUMENTS

| | | | |
|---|---|---|---|
| 3,525,312 | 8/1970 | Beck | 441/5 |
| 3,557,741 | 1/1971 | Teasdale | 114/248 |
| 3,614,938 | 10/1971 | Statile | 114/235 |
| 3,633,532 | 1/1972 | Bruce | 114/235 |
| 4,759,307 | 7/1988 | Scott | 114/74 R |
| 5,558,036 | 9/1996 | Hara | 114/249 |
| 5,660,131 | 8/1997 | Gulling et al. | 114/40 |

*Primary Examiner*—Ed Swinehart

*Attorney, Agent, or Firm*—Clifford W. Browning; Woodard, Emhardt, Naughton, Moriarty & McNett

[57] ABSTRACT

A two-part vessel for use in oil transport in waters where ice may occur, comprising a first part constituting a barge part having a bow portion and a stern portion and containing a number of loading tanks, the bow portion having a submerged receiving space for a mooring and loading buoy, and a second part constituting a propulsion part having a forward portion and a stern portion which is adapted for breaking ice, the forward portion having a forward end which is adapted for connection to the stern portion of the barge part.

15 Claims, 4 Drawing Sheets

TWO-PART SHIP FOR USE IN OIL TRANSPORT IN ARCTIC WATERS

FIELD OF THE INVENTION

The invention relates to a two-part vessel for use in oil transport in waters where ice may occur.

SUMMARY OF THE INVENTION

The object of the invention is to provide a two-part vessel of said type which enables an optimal utilization and simultaneously covers the needs for see oil transport, supply and stand-by services, together with ice breaking in arctic waters.

According to the invention the above-mentioned object is achieved in that the vessel comprises a first part in the form of a barge part containing a number of cargo tanks and having a bow portion having a submerged receiving space for a mooring and loading buoy, and a second part in the form of a propulsion part having a stern portion which is designed for breaking of ice, the second part with its forward end being arranged for connection to the stern portion of the barge part.

The barge part of the vessel according to the invention especially is intended for anchoring by means of a buoy of the so-called STL type, where "STL" stands for "Submerged Turret Loading". A buoy of this type is a submerged buoy comprising a central bottom-anchored member communicating with the topical source or installation via at least one flexible riser, and which is provided with a swivel unit for the transfer of oil (or gas) to storage tanks on the topical vessel. On the central buoy member there is rotatably mounted an outer buoy member which is adapted for introduction and releasable securing in a submerged, downwardly open receiving space at the bottom of the vessel, so that the vessel can turn about the anchored central buoy member under the influence of prevailing environmental forces, such as ice, wind, waves and water currents. For a further description of the STL system and the associated buoy structure reference can be made to e.g. US patent publication No. 5 564 957.

When using the two-part vessel according to the invention, an STL-barge will be brought out to the topical oil-producing field by means of a connected propulsion part, and will be anchored to an STL buoy when arriving at the field. The barge may be equipped with a remotely controlled pick-up or so-called ROP (Remotely Operated Pick-up) in order to avoid problems with a floating "messenger" or pick-up line which is connected to the submerged buoy. At the oil field there may be installed two STL loading buoys, it being then possible to load directly to several barges. Loading by means of such a system is called "Direct Shuttle Loading" (DSL). DSL eliminates the need for permanent storage tanks at the field, and can give substantial savings.

The propulsion part of the two-part vessel preferably is provided with the necessary installations in order also to be able to function as a supply vessel. This contributes to the fact that the two parts or units of the vessel can be utilized in an optimal manner for the necessary operations, something which totally seen gives an optimal economy.

The propulsion part of the vessel preferably is provided with propulsion equipment which is suitable for operation of the propulsion part in the pulling as well as the pushing mode. In waters without ice the two-part vessel normally is driven forwards with the barge part in front. In ice-bound waters, however, the vessel preferably is driven forwards with the propulsion part first, the ice breaker function thereof being utilized. In addition to this ice breaker function the propulsion part, as mentioned, also has a supply and stand-by function. With a view to the different functions, the propulsion part can be designated "Ice Breaker Supply Tug" or IBST. When the IBST vessel has brought a fully-loaded barge unit to a loading harbour, the IBST vessel can take on board a new load at the same time as the barge unit is unloaded. Power for load-transferring pumps will, with disconnected IBST, be able to be delivered from the land terminal. The propulsion part may possibly also be used as a supply ship for drilling and production platforms.

In an advantageous embodiment of the two-part vessel according to the invention, the forward end of the propulsion part is designed as a bow portion which i suitable for breaking of ice. Such a bow shape is advantageous in that it increases the operational applicability and flexibility of the propulsion part.

It is also very advantageous that also the bow portion of the barge part is designed for breaking of ice. The fact is that the ice loads to a high degree are dependent on the bow shape of the barge part, and an ice breaking bow gives substantially lower loads.

It is to be remarked that the principle with a pushable barge is previously known. As far as one knows, however, there is not known any concept where both vessel members or units have separate fields of utilization in addition to the primary function.

The invention will be further described below in connection with an exemplary embodiment with reference to the drawings, wherein

DESCRIPTION OF THE PREFERRED EMBODIMENTS

Figure 1:
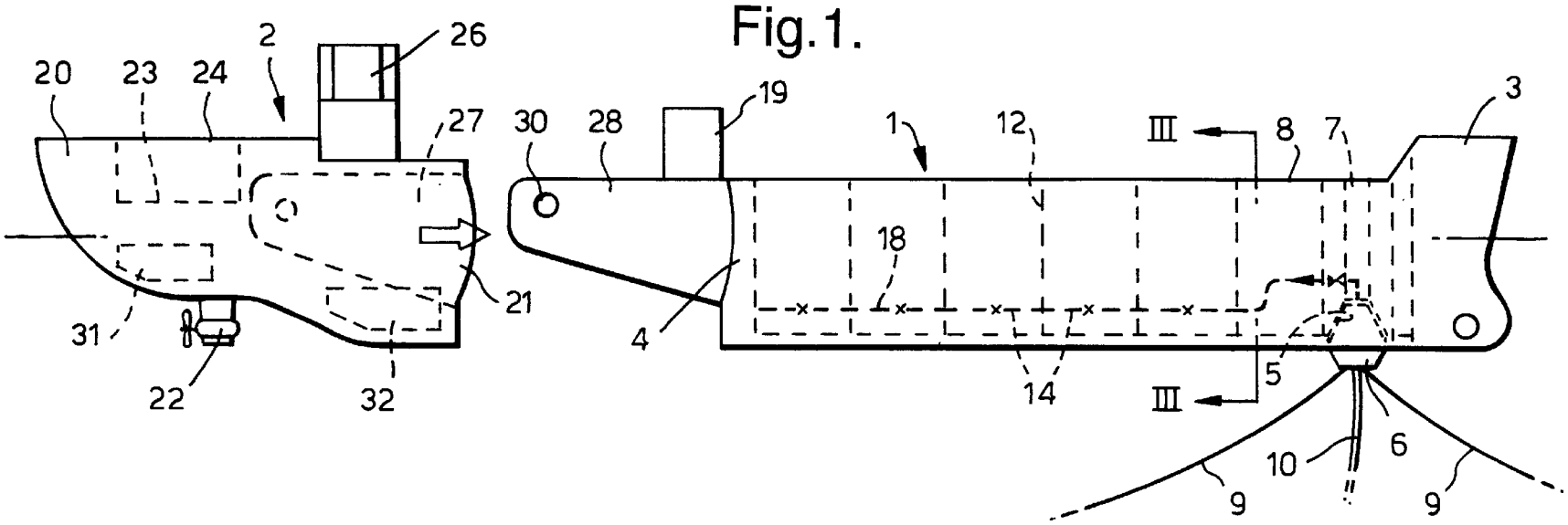
FIG. 1 shows a schematic view of a two-part vessel according to the invention, where the vessel parts are disconnected from each other.

In the drawings, similar or corresponding parts and structural elements are designated by the same reference numerals in the shown embodiments of the vessel.

Figure 2:
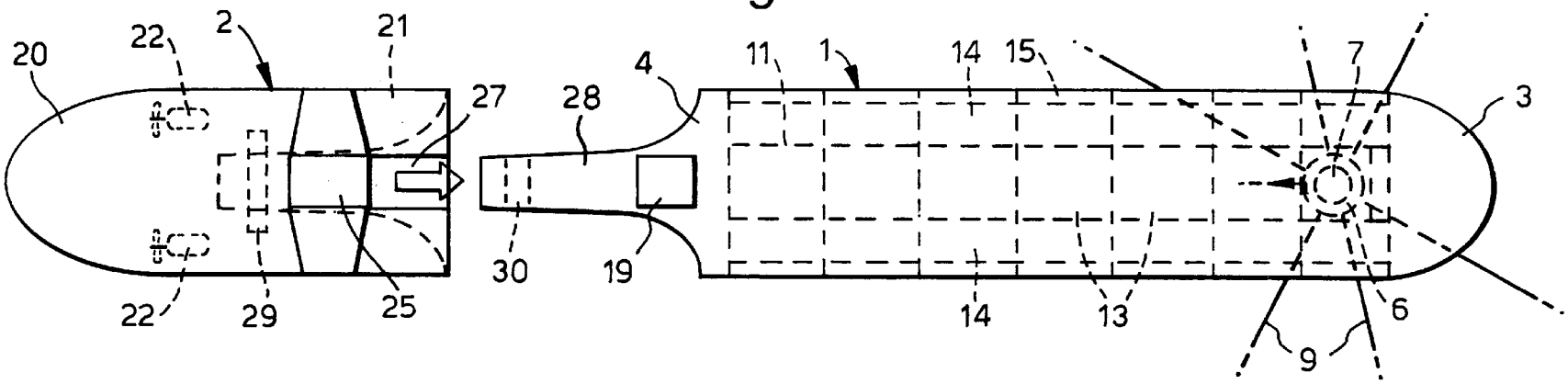
FIG. 2 shows a schematic plan view of the vessel according to FIG. 1.

The ship or vessel shown in FIGS. 1–2 comprises a first part 1 in the form of a barge part, i.e. a part which is without propulsion equipment, and a second part 2 in the form of a propulsion part which is carried out as a vessel with ice breaker function.

The barge part 1 has a bow portion 3 and a stern portion 4, and the bow portion is provided with a submerged downwardly open receiving space 5 for receiving a buoy 6 of the STL type adapted thereto, as mentioned in the introduction. Above the receiving space there is suggested a service shaft 7extending through the barge hull between the receiving space and the deck 8 of the barge. Necessary equipment (not shown) for hoisting and securing of the buoy in the receiving space is arranged in connection with the service shaft 7 and on the deck 8.

As suggested, the buoy 6 is anchored to the sea bed by means of a number of anchor lines 9, and the upper end of a flexible riser 10 from an installation or source (not shown) is connected to the buoy.

Figure 3:
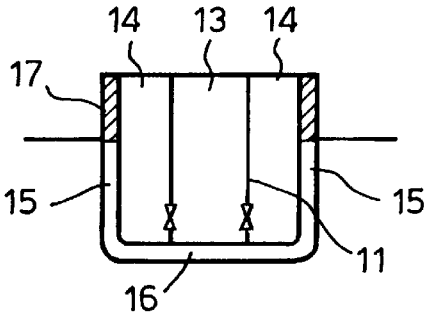
FIG. 3 shows a schematic cross-sectional view along the line III—III in FIG. 2.

The barge part 1 includes a number of loading tanks which are formed by means of longitudinal and transverse bulkheads 11 and 12, respectively. As appears, the loading tanks include a number of centre tanks 13 and a number of side or wing tanks 14. Further, the barge part is provided with side tanks 15 and with a double bottom 16. The barge part has a fixed or permanent ballast 17 which may be stored in the upper part of the side tanks 15, as shown in FIG. 3. This gives a good insulation towards the loading tanks 14. The double bottom and the side tanks in other respects may be empty, something which also gives a good insulation against heat loss.

As suggested in FIG. 1, the barge part is provided with a pipeline 18 extending between the receiving space 5 and the centre tanks 13. Thereby oil can be carried from the loading buoy 6 directly to the centre tanks 13 and further to the side tanks 14. Thereby potential problems with ice-formation on pipes/valves etc. are avoided. All equipment in the space above the buoy will also operate under controlled temperature conditions, something which will be a great advantage in arctic waters.

The barge part 1 may be equipped for unmanned operation, but a crew for monitoring the operations, typically two to three persons, may also be on board, for example during loading, when the barge part is left by the propulsion part. The barge part therefore is also equipped with a combined control centre and a smaller dwelling unit 19.

The barge part may be built in concrete, something which gives maintenance advantages in connection with operations in ice regions.

As mentioned, the propulsion part 2 has a stern portion 20 which is suitably designed for ice breaking, and a forward part 21 which is arranged for connection to the stern portion 4 of the barge part. Further, it is provided with propulsion equipment and the necessary machinery for operation of the propulsion part 2 in pulling as well as pushing mode. In order to secure the necessary manoeuvring capability of the propulsion part, the propulsion equipment comprises a pair of 360° rotatable, electrically driven propeller units or thrusters 22. The thrusters preferably are of the "Azipot"-type. By means of such a thruster installation the propulsion part in an efficient manner will be able to break ice of considerable thickness, the water being drawn away under the ice by means of the thrusters.

In order to be able to take care of the topical stand-by and supply tasks, the propulsion part according to requirement may be provided with a closed deck 23 as well as an open deck 24. In the open deck area it will be possible to place containers. Further, the propulsion part is provided with a main dwelling quarter 25, a manoeuvre bridge 26 and other conventionally necessary installations.

The arrangement for interconnection of the barge part 1 and the propulsion part 2 in the illustrated embodiment comprises a longitudinally extending, channel-shaped space 27 which is arranged in the propulsion part and debouches at the forward end 21 thereof, and an introduction member 28 which projects from the stern portion 4 of the barge part and is adapted for introduction into the channel space. In the interior of the propulsion part there is arranged one or more coupling elements for engagement in corresponding coupling elements on the introduction member 28 when this is in place in the channel space 27. The channel space is designed such that interconnection shall be able to take place in the most efficient manner. Among other things, it will be taken care that possible ice shall not be trapped in the space and prevent interconnection.

The interconnection arrangement is arranged to lock the propulsion part 2 to the barge part 1 in the pushing mode, but suitably is arranged such that the two vessel parts can be mutually movable in the pulling mode. For this purpose the above-mentioned coupling elements may consist of a hydraulically operated turning shaft 29 which is provided in the propulsion part, and a hole 30 adapted thereto in the introduction member 28, so that the propulsion part is limitedly rotatable about the turning shaft 29 when this is carried through the hole 30. The coupling element possibly may also comprise e.g. hydraulically or pneumatically activated buffer means which can be activated in the interspace between the inner wall of the channel space and the introduction member, and/or supplementary coupling means of mechanical kind.

The propulsion part 2 is provided with ballast tanks 31, 32 to be able to adapt the draught and trim of the propulsion part to the stern end 4 of the barge part 1. This is necessary in order to be able to carry out efficient and safe interconnection and disconnection of the vessel parts in relation to one another. The shape and size of the ballast tanks will be adapted to the different needs.

In the embodiment according to FIGS. 1–3, the two parts of the vessel have the same width. However, the two parts or units may also have different widths.

Figure 4:
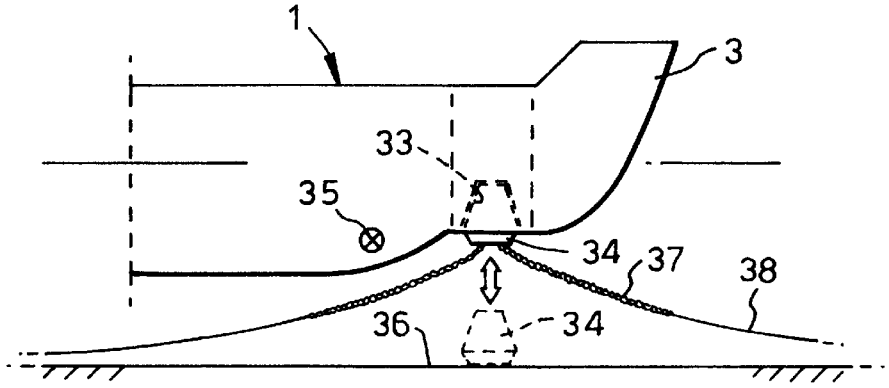
FIG. 4 shows a side view of the forward part of a barge part having an alternative design.

The barge part of the two-part vessel may also be especially adapted for operation in shallow waters. This is achieved by forming the bow portion as shown in FIG. 4. The bottom of the bow portion 3 in this embodiment is raised in relation to the rest of the bottom of the barge part 1, so that the region in which the receiving space 33 for the buoy 34 is arranged, as a smaller draught than the rest of the barge part. Except for this difference the barge part may be designed as described above. For achieving manoeuvring capability, the barge is provided with a thruster 35 which in this embodiment is placed behind the region of the receiving space 33.

In the shown case, the buoy 34 is designed such that it can be placed on the sea bed 36 when it is disconnected from the barge part. The buoy is anchored by means of a number of anchor lines which is shown to consist of a chain part 37 and a wire part 38.

The special bow design makes it possible to use relatively large vessels (typically 100 000–140 000 dead-weight tons) on water depths down to 20–25 m. Such a design of the bow portion may be of substantial importance, since the topical arctic regions are often very "shelving and shallow".

It may also be of interest to lower the sea bed locally where the buoy is put down. This will also make it possible for large vessels to operate in shallow water.

Another embodiment of the vessel according to the invention is shown in FIGS. 5–13. The main difference in relation to the embodiment according to FIGS. 1–3 is that both the forward end of the propulsion part as well as the bow portion of the barge part in the embodiment according to FIGS. 5–13 are designed for breaking of ice. As mentioned in the introduction, this may have substantial operational and working advantages. As mentioned above, corresponding parts and structural elements are designated by the same reference numerals in the shown embodiments. The description of such parts/elements which are described above, will not be repeated for the embodiment according to FIGS. 5–13, reference instead being made to the preceding description.

Figure 5:
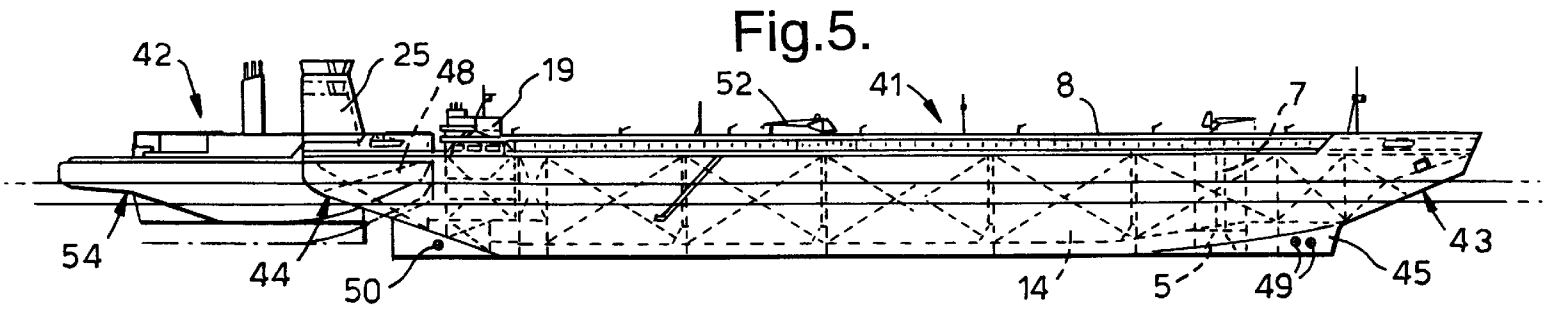
FIG. 5 shows a schematic side view of another embodiment of a two-part vessel according to the invention.
Figure 6:
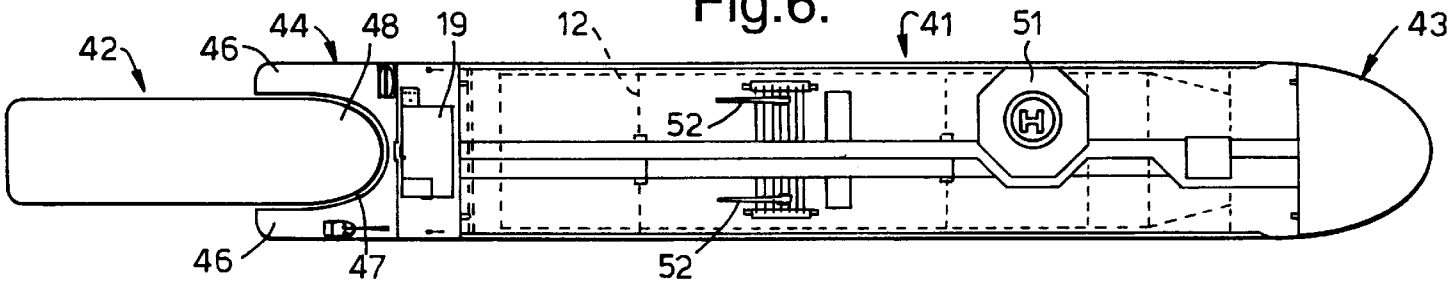
FIG. 6 shows a schematic plan view of the vessel according to FIG. 5.
Figure 7:
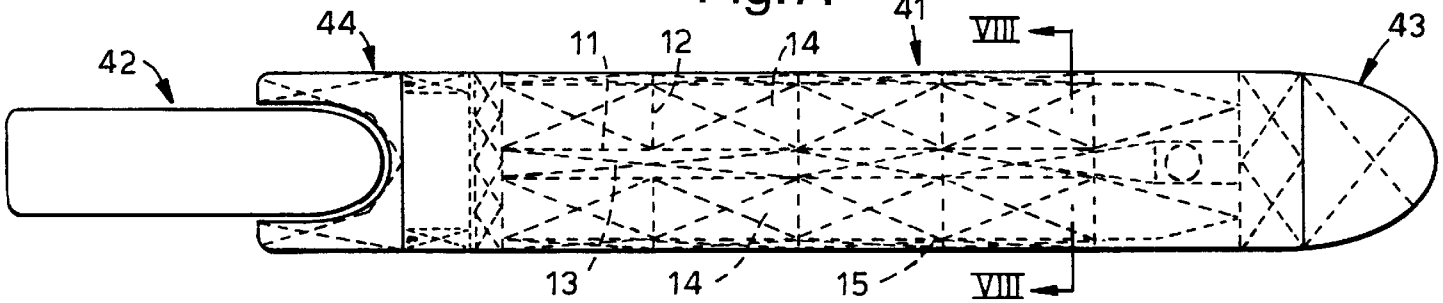
FIG. 7 is a schematic plan view illustrating the tank arrangement in the barge part of the vessel according to FIG. 5.

As shown in FIGS. 5–7, the vessel or ship comprises a first part or barge part 41 and a second part or propulsion part 42. The barge part has a bow portion 43 and a stern or aft portion 44. As mentioned, the bow portion is designed for breaking of ice, and for this purpose has a downwards and backwards slanting underside. The bow shape is optimized for ice operations at the same time as one has kept in mind the pitching properties of the barge part in open sea.

Figure 9:
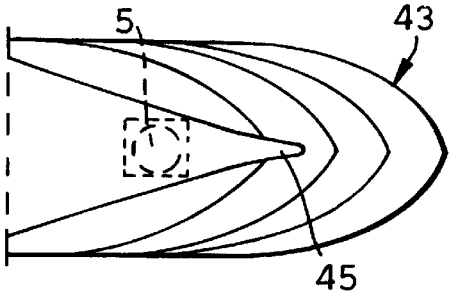
FIGS. 9 and 10 are a bottom plan view and a front view, respectively, illustrating the bow shape of the barge part in FIGS. 7–9.
Figure 10:
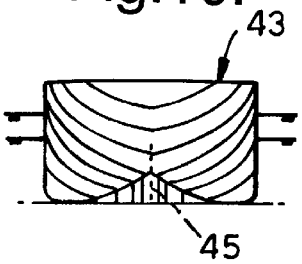

In a manner corresponding to that of the first embodiment, the bow portion is provided with a receiving space 5 for a buoy of the STL type. The bow shape of the barge must protect the STL system against ice loads, and the bottom portion of the bow is designed or shaped for this purpose. Thus, as best shown in FIGS. 9 and 10, the bow has a forward keel member 45 which is formed as an ice plough to push aside ice, such that minimal direct ice loads will be directed towards the STL system when the ice field moves in the direction thereof.

The stern portion 44 of the barge part in this embodiment has two backwards projecting side arms 46 defining a central notch 47 having a shape which is adapted for receiving a bow portion 48 of the propulsion part 42 similarly shaped in plan view. Thus, the propulsion part in this embodiment has a substantially smaller width than the barge part. As appears from FIG. 5, the side arms 46 have downwardly and forwardly slanting undersides, to optimize the stern end shape, with a view to improving the astern-going ability of the vessel. An optimized stern end appropriately has an inclined angle of about 18° and rounded ribs.

The arrangement for mechanical interconnection of the barge part 41 and the propulsion part 42 is not more specifically shown, but will be able to be designed in many different ways, possibly along lines corresponding to those described above for the first embodiment. The arrangement must allow interconnection of the vessel parts in different relative height positions, according to the draught and trim of the barge part, in dependence of the filling of the loading tanks.

As appears from FIG. 5, the barge part is equipped with a pair of bow thrusters 49 and a stern or aft thruster 50. Further, FIG. 6 shows that the barge part i.a. is also provided with a helicopter deck 51 and cranes 52 for handling of equipment.

Figure 8:
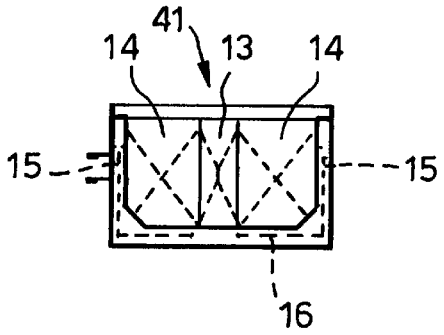
FIG. 8 shows a schematic cross-sectional view along the line VIII—VIII in FIG. 7.

A cross sectional view of the hull of the barge part 41 is shown in FIG. 8, wherein the barge part is shown to have vertical sides. It may, however, be advantageous that the barge part has inwards inclined sides, especially in the water-line region, as this gives smaller ice loads because of the fact that colliding ice is deflected along the ship side. Thereby less ice reinforcement is required, but the construction becomes somewhat more complicated. Such a hull shape will also give better manoeuvring ability.

Figure 11:
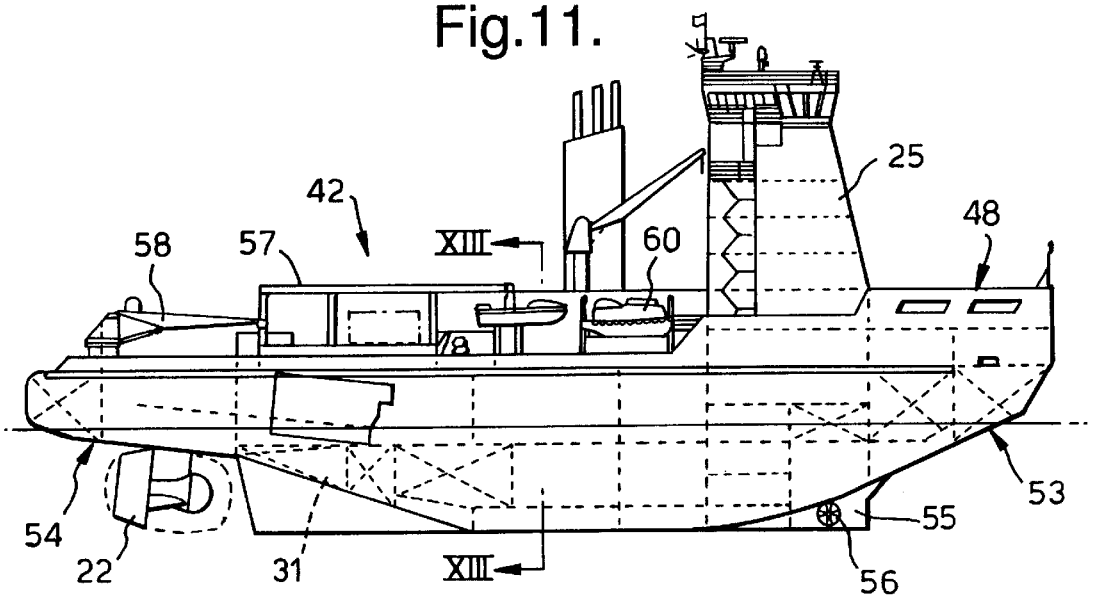
FIGS. 11–12 show a side view and a plan view, respectively, of the propulsion part of the vessel according to FIGS. 7–9.
Figure 12:
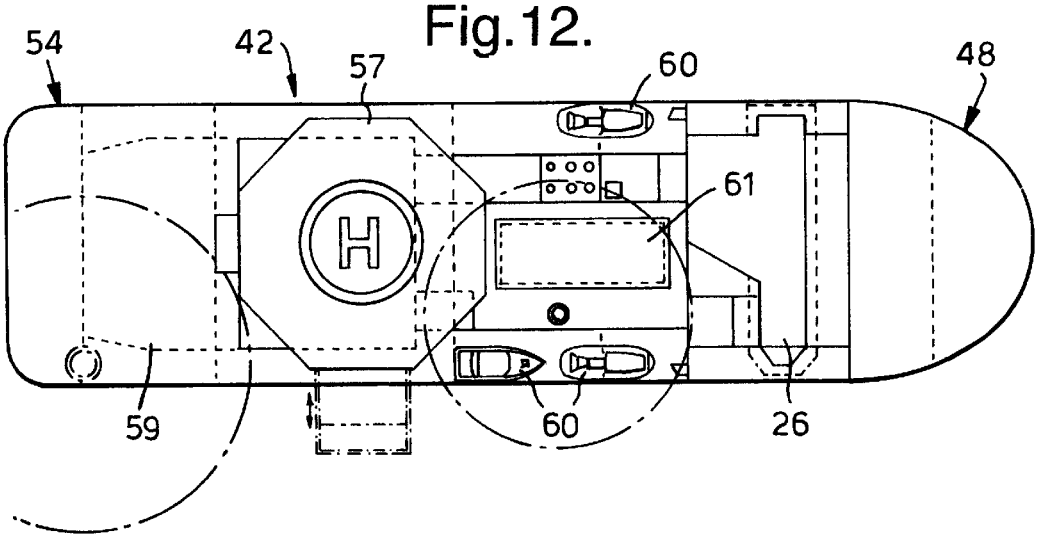
Figure 13:
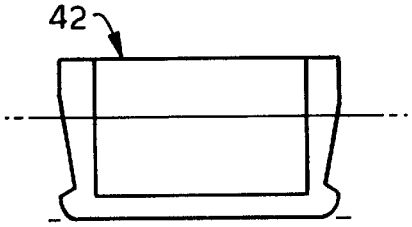
FIG. 13 is a schematic cross-sectional view illustrating the hull shape, along the line XIII—XIII in FIG. 11.

The propulsion part 42 is shown more in detail and on a larger scale in FIGS. 11–13. As mentioned above, the propulsion part in this embodiment is able to break ice both with its bow end 53 and with its stern end 54. By means of such a hull design the propulsion part can operate independently, both as an ice breaker and as, e.g., a supply ship for drilling and production platforms.

The hull shape of the propulsion part is optimized for ice breaking at the same time as one has taken into account the properties of the vessel in open sea. Because of operation in shallow waters, the draught of the propulsion part advantageously is relatively small, e.g. 8–9 m, to permit freer operations. The bow end of the vessel is formed with a modern, ice breaking bow having low V-angled ribs to avoid pitching. Further, the bilge, e.g. the rounded portion of the vessel bottom, preferably is stepped to reduce rolling. As appears from FIG. 11, the vessel has a forward keel member 55 which is formed as an ice plough, in a similar manner as in the bow portion of the barge part, in order to push ice aside, to minimize ice loads on the propulsion system.

As appears from the cross-sectional view in FIG. 13, the vessel has inwards inclined sides, to improve the manoeuvring properties.

As will be understood, the propulsion part or the vessel 42 is provided with propulsion equipment and the necessary machinery for operation in both pushing and pulling mode, as in the first embodiment. Thus, a thruster unit 22, e.g. of the "Azipot" type, is arranged at the stern end 54 of the vessel. Further, in the forward bottom portion 55 there is arranged a bow thruster 56, for improved manoeuvring ability.

The vessel 42 in principle is provided with the same facilities as the propulsion part 2. Further, the vessel in FIGS. 11–12 is especially shown to be equipped with a helicopter deck 57, a crane 58 for handling of equipment on a working deck 59, a number of lifeboats 60, a hold/helicopter hangar under a hatch 61, and a number of interior rooms (suggested with dashed lines in FIG. 11), i.a. for mechanical equipment and for personnel convenience.

The propulsion part 42 is presupposed to be classified as a pusher vessel and as an arctic supply ship for unlimited service. Other tasks, in addition to ice-breaking operations, may include bringing along of deck load and offshore equipment
DP operations
towing operations
oil recovery operations
rescue/salvage operations
fire-fighting operations
research operations The ice-breaking capacity of the vessel when this works alone, in the shown embodiment is presupposed to be approximately 1.8 m of smooth ice.

What is claimed is:

1. A two-part vessel for use in oil transport in waters where ice may occur, comprising a first part constituting a barge part having a bow portion and a stern portion and containing a number of loading tanks, the bow portion having a submerged receiving space for a mooring and loading buoy, and a second part constituting a propulsion part having a forward portion and a stern portion which is adapted for breaking ice, said forward portion having a forward end which is adapted for connection to the stern portion of the barge part.

2. A two-part vessel according to claim 1, wherein the propulsion part is provided with installations enabling said part to function as a supply vessel.

3. A two-part vessel according to claim 1, wherein the propulsion part is provided with propulsion equipment which is suitable for operation of the propulsion part in both a pulling mode and a pushing mode.

4. A two-part vessel according to claim 3, wherein the propulsion equipment comprises a pair of 360° rotatable thrusters.

5. A two-part vessel according to claim 3, wherein the two vessel parts are provided with an interconnection arrangement which is arranged to lock the propulsion part to the barge part in said pushing mode.

6. A two-part vessel according to claim 5, wherein the interconnection arrangement is arranged such that the propulsion part and the barge part are mutually movable in said pulling mode.

7. A two-part vessel according to claim 5, wherein the interconnection arrangement comprises a longitudinally extending, channel-shaped space which is arranged in the propulsion part and debouches at the forward end thereof, and an introduction member projecting from the stern portion of the barge part and having a shape which is adapted to the channel space, one or more coupling elements being provided in the propulsion part for engagement in corresponding coupling elements on the introduction member.

8. A two-part vessel according to one of the preceding claims, wherein the propulsion part is provided with ballast tanks for adaptation of the draught and trim of the propulsion part to the stern portion of the barge part.

9. A two-part vessel according to any one of claims 1 to 7, wherein the forward portion of the propulsion part is designed as a bow portion which is suitable for breaking of ice.

10. A two-part vessel according to any one of claims 1 to 7, wherein the bow portion of the barge part is designed for breaking of ice.

11. A two-part vessel according to claim 10, wherein the bow portion of the barge part has an underside which is downwardly slanting in side view and which, ahead of the receiving space for the buoy, passes into a bottom portion which is designed for protecting the receiving space and the buoy against ice loads.

12. A two-part vessel according to any one of claims 1 to 7, wherein the barge part is provided with side tanks which, in their upper part, are completely or partly filled with a solid, permanent ballast.

13. A two-part vessel according to any one of claims 1 to 7, wherein the barge part is built in concrete.

14. A two-part vessel according to any one of claims 1 to 7, the barge part is provided with a pipeline for carrying oil from the loading buoy directly to one or more centre tanks and further to side tanks.

15. A two-part vessel according to any one of claims 1 to 7, wherein the bottom of the barge part in the bow portion is raised in relation to the rest of the bottom, so that the region of the receiving space for the buoy has a smaller draught than the rest of the barge part.

* * * * *

UNITED STATES PATENT AND TRADEMARK OFFICE

CERTIFICATE OF CORRECTION

PATENT NO. : 6,162,105
DATED : December 19, 2000
INVENTOR(S) : Kare G. Breivik

It is certified that error appears in the above-identified patent and that said Letters Patent is hereby corrected as shown below:

Title page,
Please change the PCT filing date from "Sep. 9, 1977" to -- Sep. 9, 1997 --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*